US008052586B2

(12) United States Patent
Hahn

(10) Patent No.: US 8,052,586 B2
(45) Date of Patent: Nov. 8, 2011

(54) LADDER BARREL WITH CAM LOCK

(75) Inventor: Christopher J. Hahn, Longmont, CO (US)

(73) Assignee: Hart Wood, Inc., Longmont, CO (US)

( * ) Notice: Subject to any disclaimer, the term of this patent is extended or adjusted under 35 U.S.C. 154(b) by 0 days.

(21) Appl. No.: 12/686,182

(22) Filed: Jan. 12, 2010

(65) Prior Publication Data

US 2010/0179038 A1 Jul. 15, 2010

Related U.S. Application Data

(60) Provisional application No. 61/144,375, filed on Jan. 13, 2009.

(51) Int. Cl.
*A63B 26/00* (2006.01)

(52) U.S. Cl. ..... 482/142

(58) Field of Classification Search ..... 482/35, 482/36, 131, 132, 142, 144, 95, 96, 140; 472/135, 136
See application file for complete search history.

(56) References Cited

U.S. PATENT DOCUMENTS

| | | | | |
|---|---|---|---|---|
| 2,396,341 | A * | 3/1946 | Perry | 472/116 |
| 2,673,736 | A * | 3/1954 | Fiumedoro | 482/142 |
| 4,398,713 | A * | 8/1983 | Ellis | 482/145 |
| D284,597 | S | 7/1986 | Smith et al. | |
| 4,884,804 | A | 12/1989 | Fenwick | |
| 4,911,438 | A | 3/1990 | Van Straaten | |
| 5,066,005 | A | 11/1991 | Luecke | |
| 5,221,246 | A * | 6/1993 | Torii | 482/144 |
| 5,338,278 | A | 8/1994 | Endelman | |
| 6,371,895 | B1 | 4/2002 | Endelman et al. | |
| 6,527,685 | B2 | 3/2003 | Endelman et al. | |
| 6,692,418 | B2 * | 2/2004 | Shahan | 482/144 |
| 7,104,937 | B2 | 9/2006 | Arbuckle et al. | |
| 7,179,207 | B2 | 2/2007 | Gerschefske | |
| 7,288,053 | B2 | 10/2007 | Endelman et al. | |
| 7,311,644 | B2 | 12/2007 | Hale | |
| 7,452,313 | B2 * | 11/2008 | Endelman | 482/140 |
| 2006/0116262 | A1 * | 6/2006 | Pandozy | 482/142 |
| 2008/0015096 | A1 * | 1/2008 | Isacowitz et al. | 482/130 |
| 2008/0161173 | A1 * | 7/2008 | Campanaro et al. | 482/133 |
| 2010/0152004 | A1 * | 6/2010 | Feltz | 482/142 |

* cited by examiner

*Primary Examiner* — Allana Lewin
(74) *Attorney, Agent, or Firm* — Margaret Polson; Oppedahl Patent Law Firm LLC

(57) ABSTRACT

A ladder barrel for use in Pilates type exercise is disclosed. The adjustment mechanism to hold the barrel in place on the floor rail comprises a locking rail and a cam mechanism to press the locking rail into engagement with the floor rail, holding the barrel in position. The locking rail has spring biased plungers to hold it out of engagement with the floor rail when the cam is not engaged.

10 Claims, 8 Drawing Sheets

LADDER BARREL WITH CAM LOCK

CROSS REFERENCE APPLICATIONS

This application is a non-provisional application claiming the benefits of provisional application Ser. No. 61/144,375 filed Jan. 13, 2009.

BACKGROUND

Ladder barrels are a well known piece of exercise equipment, most often used in a Pilates type exercise program. In order to be usable by a number of people, it is well known in the art to make the ladder barrel 100 such that the distance between the barrel 101 and the ladder 102 can be varied by sliding the barrel along the floor rails 103. In prior art ladder barrel (not shown) the barrel 101 is generally secured to the floor rails with threaded clamps. It is important that the barrel 101 be firmly secured in place, since any movement of the barrel during use could result in injury to a user. However, threaded clamps can be difficult to screw tight enough and, if screwed tight enough, can be difficult to unscrew.

The foregoing example of the related art and limitations related therewith are intended to be illustrative and not exclusive. Other limitations of the related art will become apparent to those of skill in the art upon a reading of the specification and a study of the drawings.

SUMMARY

One aspect of the present invention is to provide a ladder barrel that can be easily adjusted in a safe, secure manner.

The following embodiments and aspects thereof are described and illustrated in conjunction with systems, tools and methods which are meant to be exemplary and illustrative, not limiting in scope. In various embodiments, one or more of the above described problems have been reduced or eliminated, while other embodiments are directed to other improvements.

In addition to the exemplary aspects and embodiments described above, further aspects and embodiments will become apparent by reference to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION OF THE DRAWINGS

Figure 1:
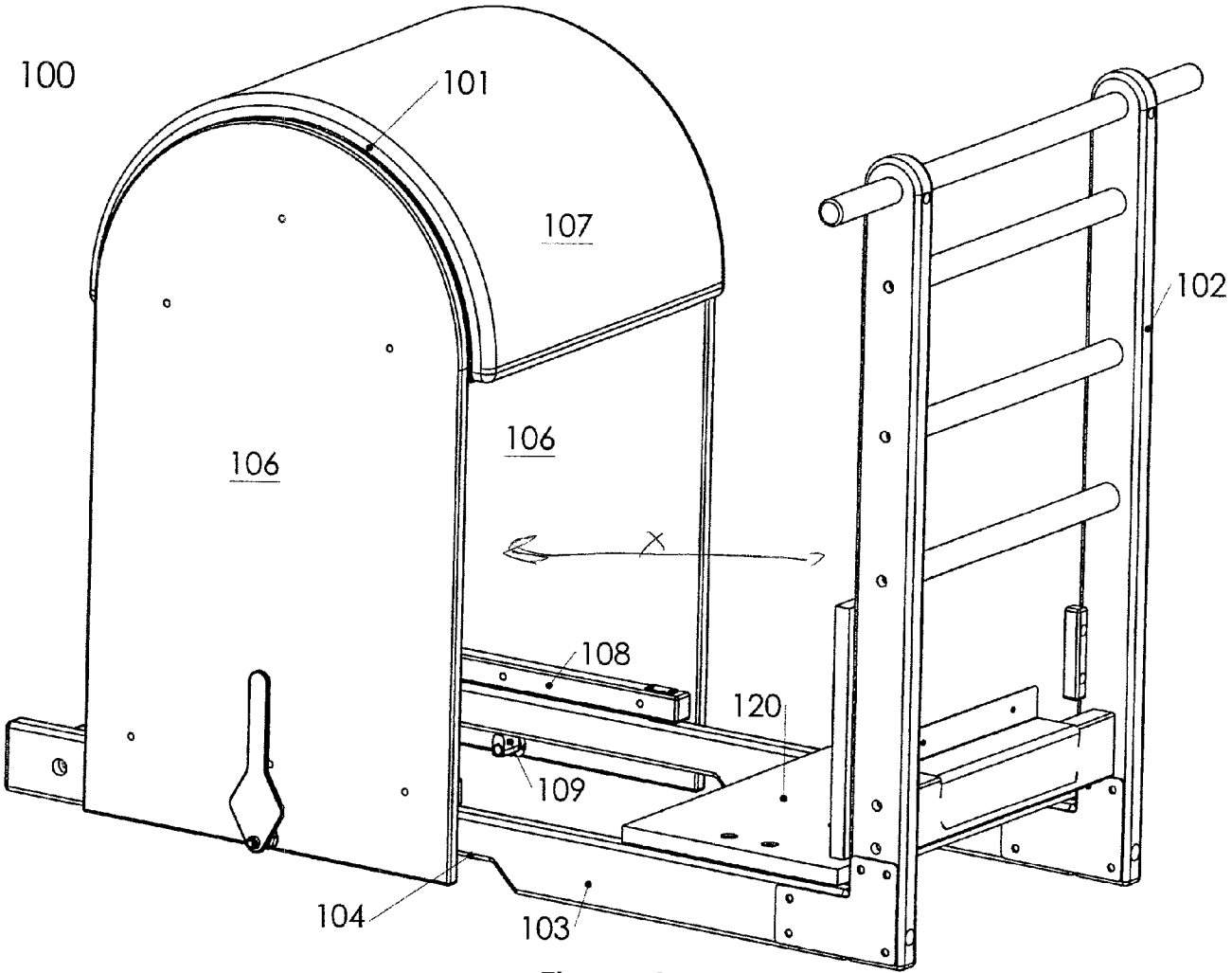
FIG. 1 is a back perspective view of a ladder barrel.
Figure 2:
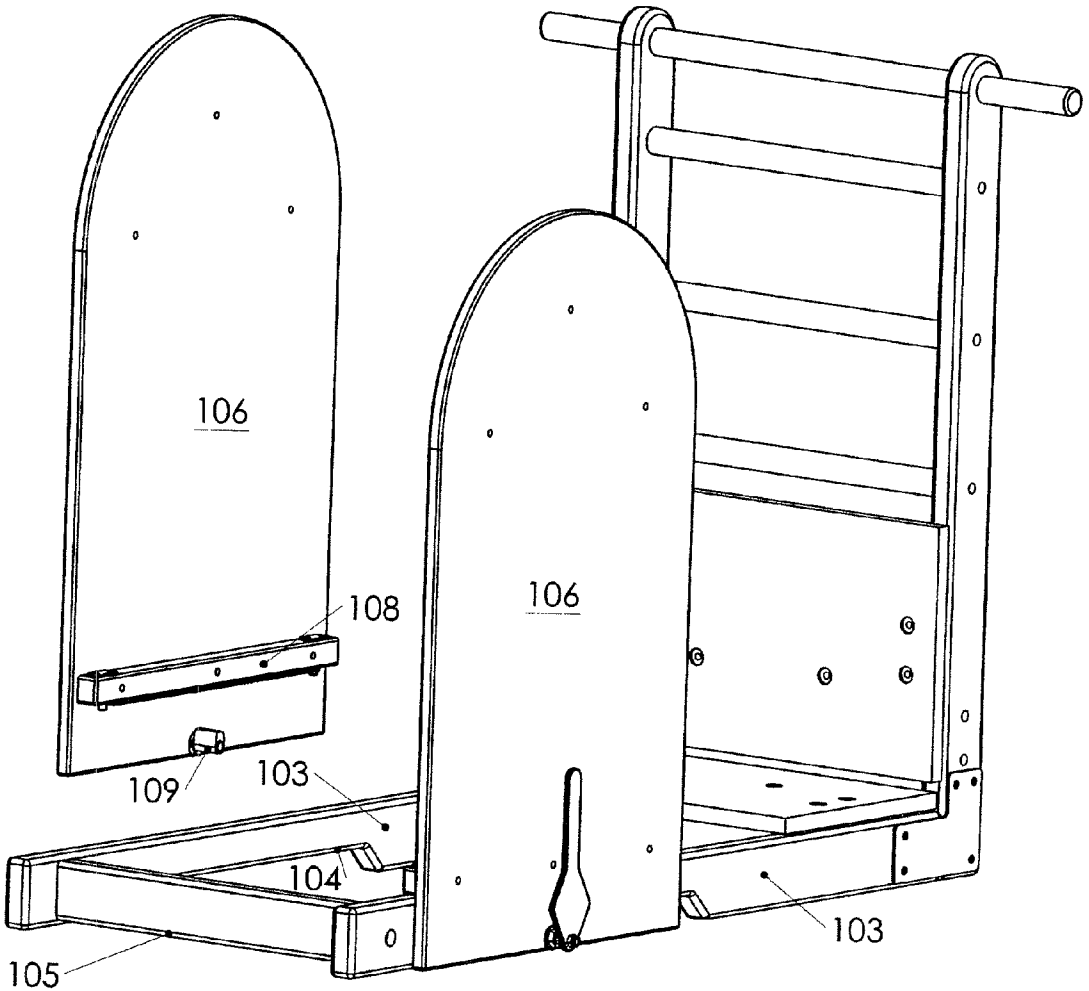
FIG. 2 is a partially exploded view of the barrel sides and floor rails.

Referring first to FIG. 1, the ladder barrel 100 has a barrel 101 and ladder 102 connected with floor rails 103. The barrel 101 slides on floor rails 103 to allow the user to adjust the distance X between the ladder 102 and barrel 101. The ladder 102 is attached at one end of the floor rails 103. The floor rails 103 have their height reduced by recess 104 along a portion of the length on the underside in order to accommodate the cam 109 in the depicted embodiment. Alternatively, the floor rail 103 could have feet at each end to control the amount of distance the barrel 101 could travel (not shown). The floor rails 103 are connected together at the end opposite the ladder 102 by end piece 105, as shown in FIG. 2. These end pieces 105 could also act as a stop on that end of the floor rails 103. The board 120 is an optional piece that allows the user to change effective height of barrel by changing the surface that the user is standing on and is known in the art. The floor rail 103, ladder 102 and end piece 105 form a rigid, rectangular frame that sits on the floor. The size of the rectangle will depend on the desired width of the ladder barrel and the range of length X desired in a given device.

The barrel 101 has two mirror image sides 106 and a top 107. Each side 106 has on its lower inner surface a locking rail 108 and a rotatably mounted cam 109 which are parts of the adjustment mechanism, as discussed below. The locking rail 108 and the cam 109 are spaced vertically apart by a distance that is slightly larger the dimension of the floor rail 103 at the recess 104 as seen in FIGS. 1 and 2. The two sides 106 are placed with the cam 109 and locking rail 108 in position in the recess 104 and are then held in place by top 107.

Figure 3:
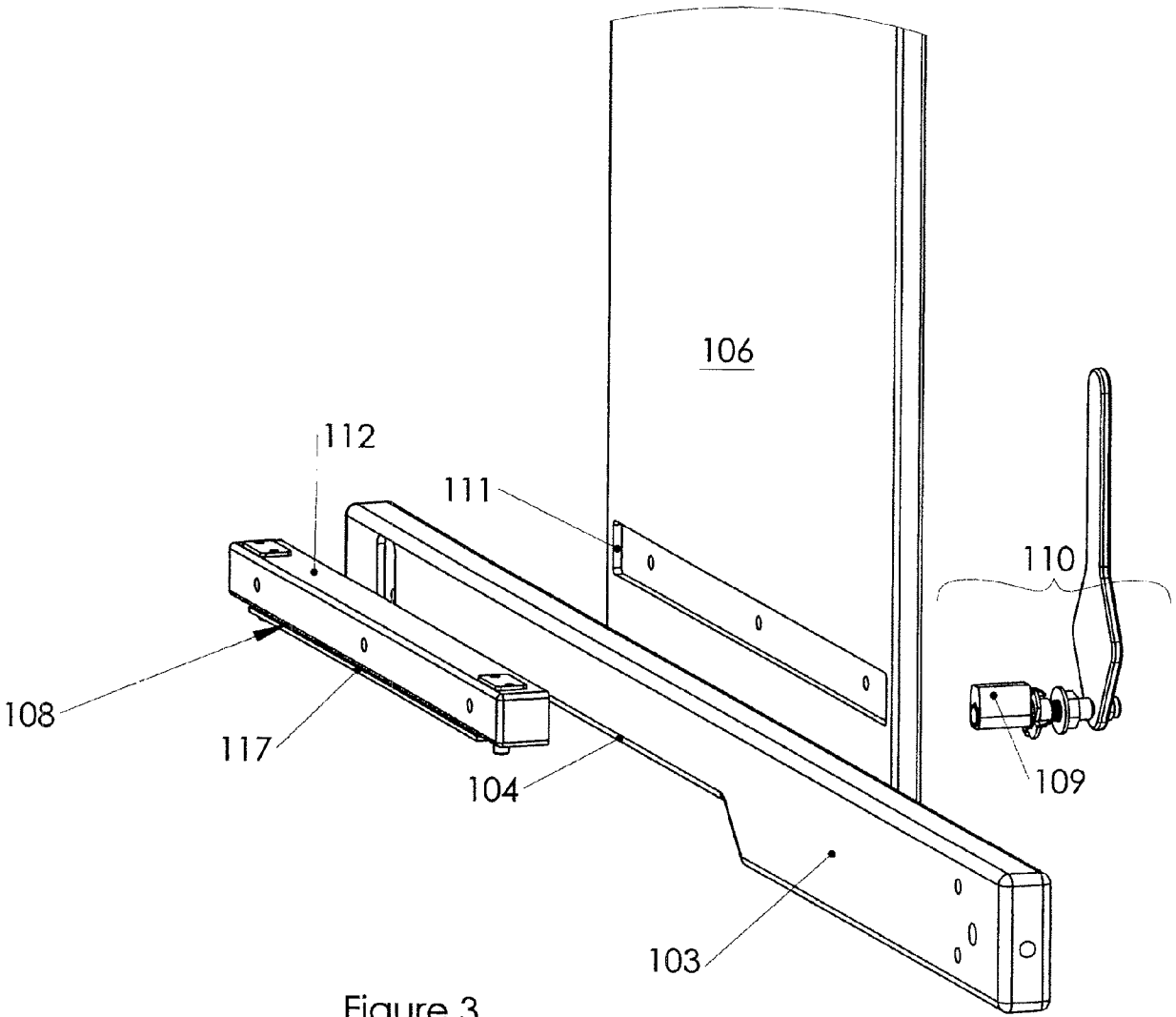
FIG. 3 is a partially exploded view of the floor rail, cam lock, locking rail, and barrel side.
Figure 4:
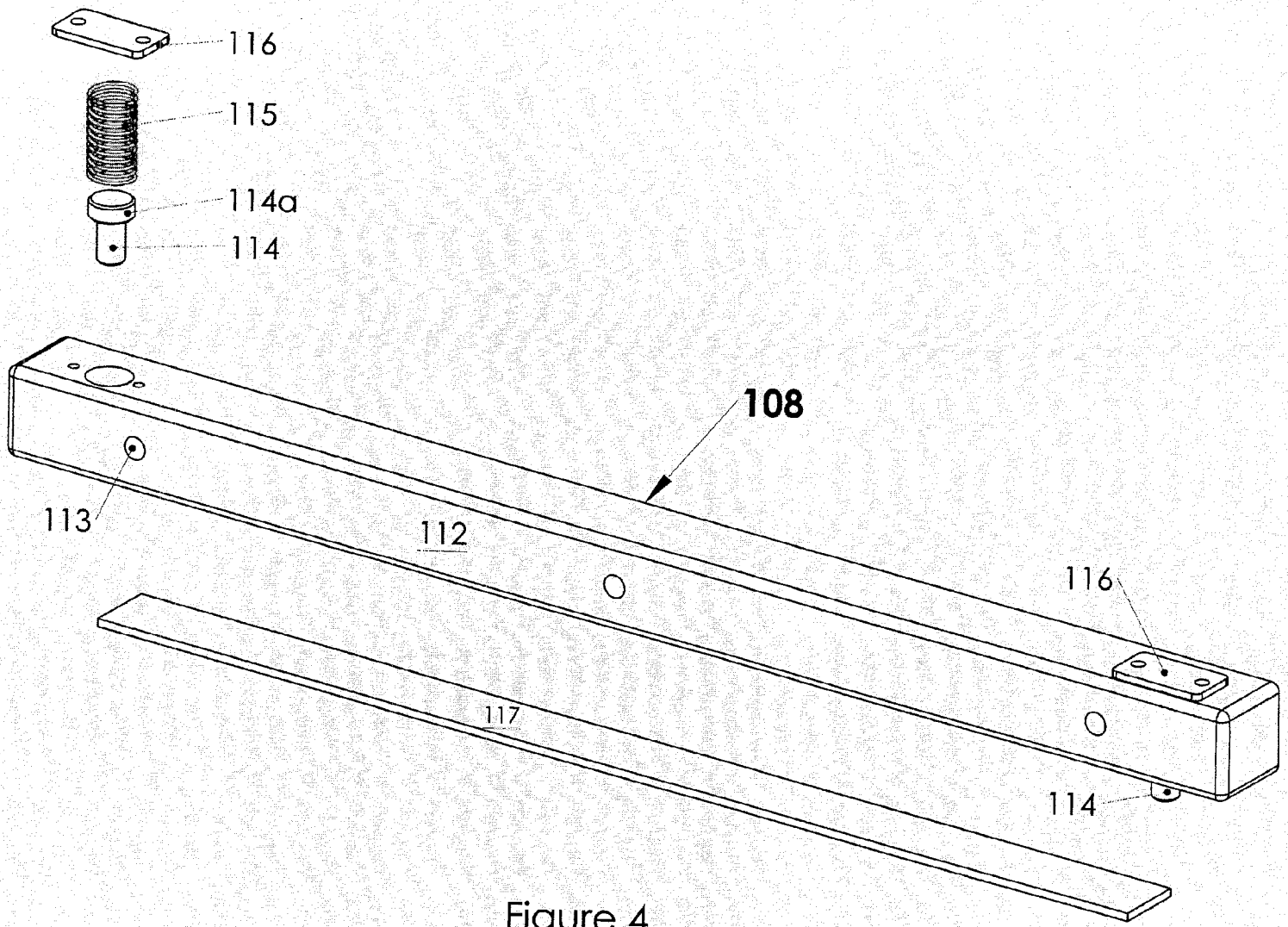
FIG. 4 is an exploded view of the locking rail.

Referring next to FIG. 3, each side 106 has a recess 111 for precisely locating and maintaining the position of the locking rail 108, where it is attached to the side 106. The locking rail 108 must be in a fairly precise location relative to the cam 109 in order to properly engage the friction pad to produce a sufficient coefficient of friction to hold the barrel in a fixed position when being used by a person to perform various maneuvers on the ladder barrel 100. The exact distance will depend on the thickness and coefficient of friction of the friction pad The recess 111 allows for the locking rail 108 to be installed in a set location. Other means of precisely locating the locking rail 108 relative to the cam 109 would work as well. The locking rail 108 can be attached with screws, nails, glue, welding or other known attachment mechanism. Alternatively, the body 112 of the locking rail 108 can be formed as part of the side 106. The cam assembly 110 is rotatably mounted in hole (not shown) below the locking rail 108. Alternately, the cam and the locking rail could be reversed, with the cam on top (not shown). The locking rail 108 has a body 112 with at least two spring-mechanism holes 113, as seen in FIG. 4. Plungers 114 are placed in the spring mechanism holes 113, along with springs 115 and caps 116. The plungers 114 are placed in the holes 113 with the spring 115 between the plunger 114 and the cap 116. The top **114*a* of the plunger 114 is wider that the remainder of the plunger 114 in order to retain the plunger 117 in spring mechanism holes 113. The holes 113 have a corresponding narrowing at the bottom to retain the top 114*a* in the holes 113. The spring 115 acts to bias the plungers 114 to the extended position with at least a portion of the plungers 114 extending from the body 112 by a dimension greater than the thickness of the friction pad 117. If desired the spring 115 could be replaced with some other biasing means and the plungers 114 could be replaced with some other spacer, for example spheres. Other methods of mounting the plungers 114** such that they are biased to an extended position could be used as well.

The plungers 114 extend from the side of the body 112 that will be in contact with floor rail 103. The extending portion of the plungers form feet. Friction pad 117 is placed along the bottom surface of the body 112 between the plungers 114. Friction pad 117 is made from an elastic material, which is gum rubber in the depicted embodiment. It needs to be compressible, and have a sufficient coefficient of friction to function as discussed below.

Figure 5:
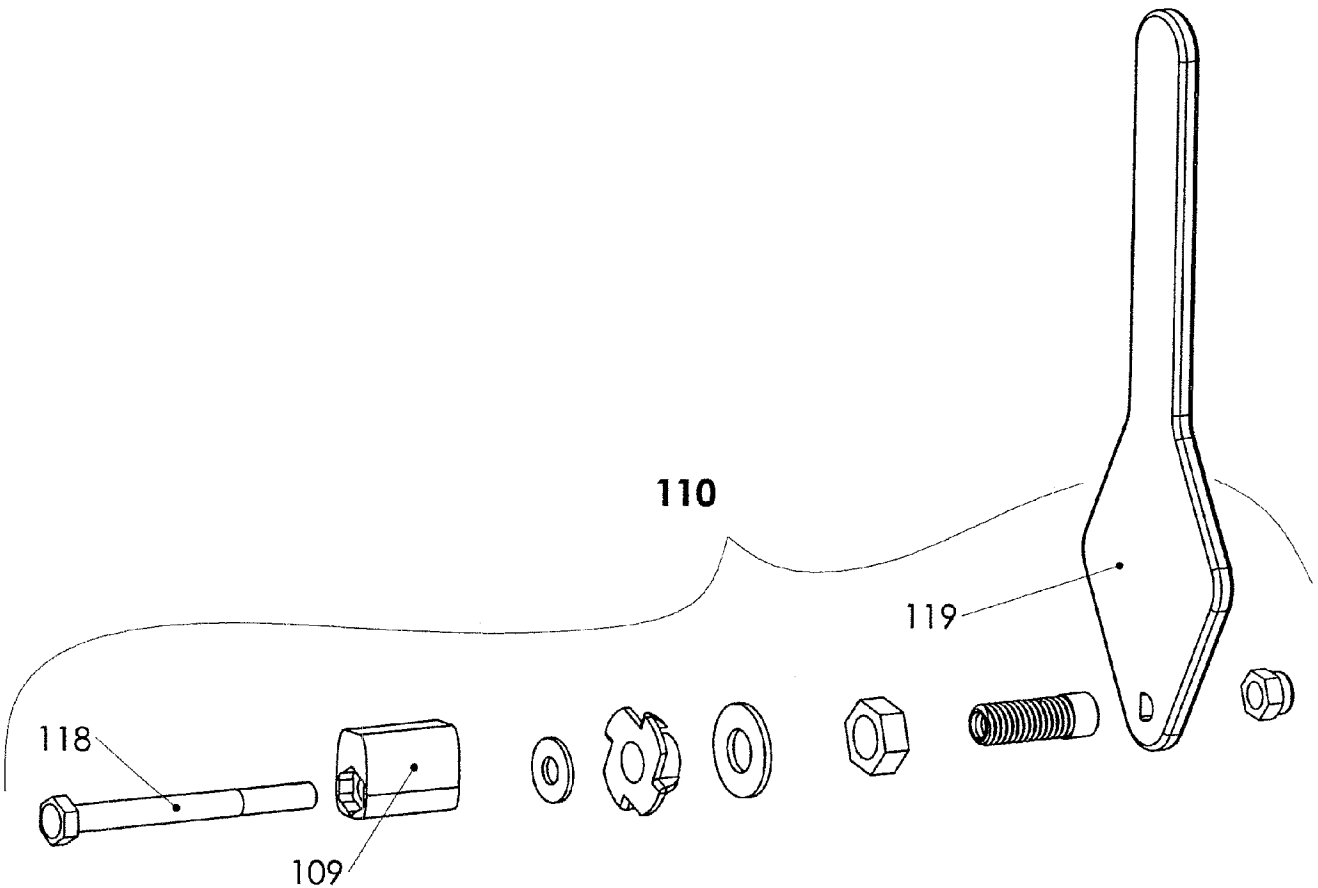
FIG. 5 is an exploded view of the cam assembly.

FIG. 5 is an exploded view of the cam assembly 110. The cam 109 is placed on a bolt 118 and attached to handle 119 with appropriate hardware. The remaining hardware both rotatably attaches the cam assembly perpendicularly to side 106 and comprises the axle against which the cam rotates. It is understood that there are any number of hardware configurations that could be used to form a functioning cam assembly 110. The cam assembly must be sturdy enough to lock the barrel in place as described below and to function repeatedly without failing.

Figure 6:
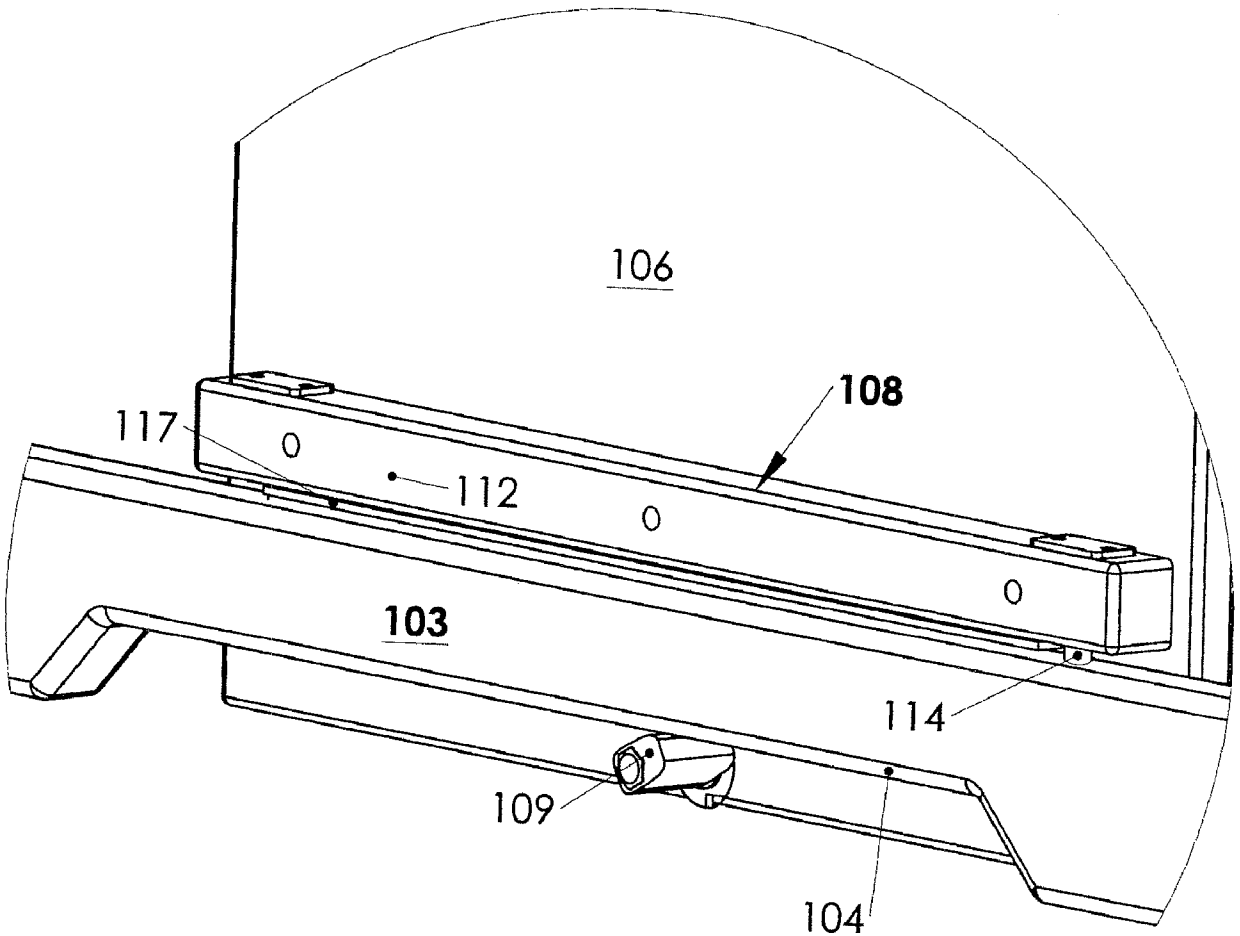
FIG. 6 is a side view of the adjustment mechanism with the cam assembly in the unlocked position.

The side 106 mounted on side rail 103 is seen in FIG. 6, with the cam 109 in the unlocked position. In this position, the springs push the plungers 114 out and against the top surface of rail 103, disengaging the friction pad 117 such that it is either not in contact with the surface of the floor rail, or only in very minimal contact. This simultaneously lifts the barrel 100, allowing it to be slid to a desired location along rails 103.

Figure 7:
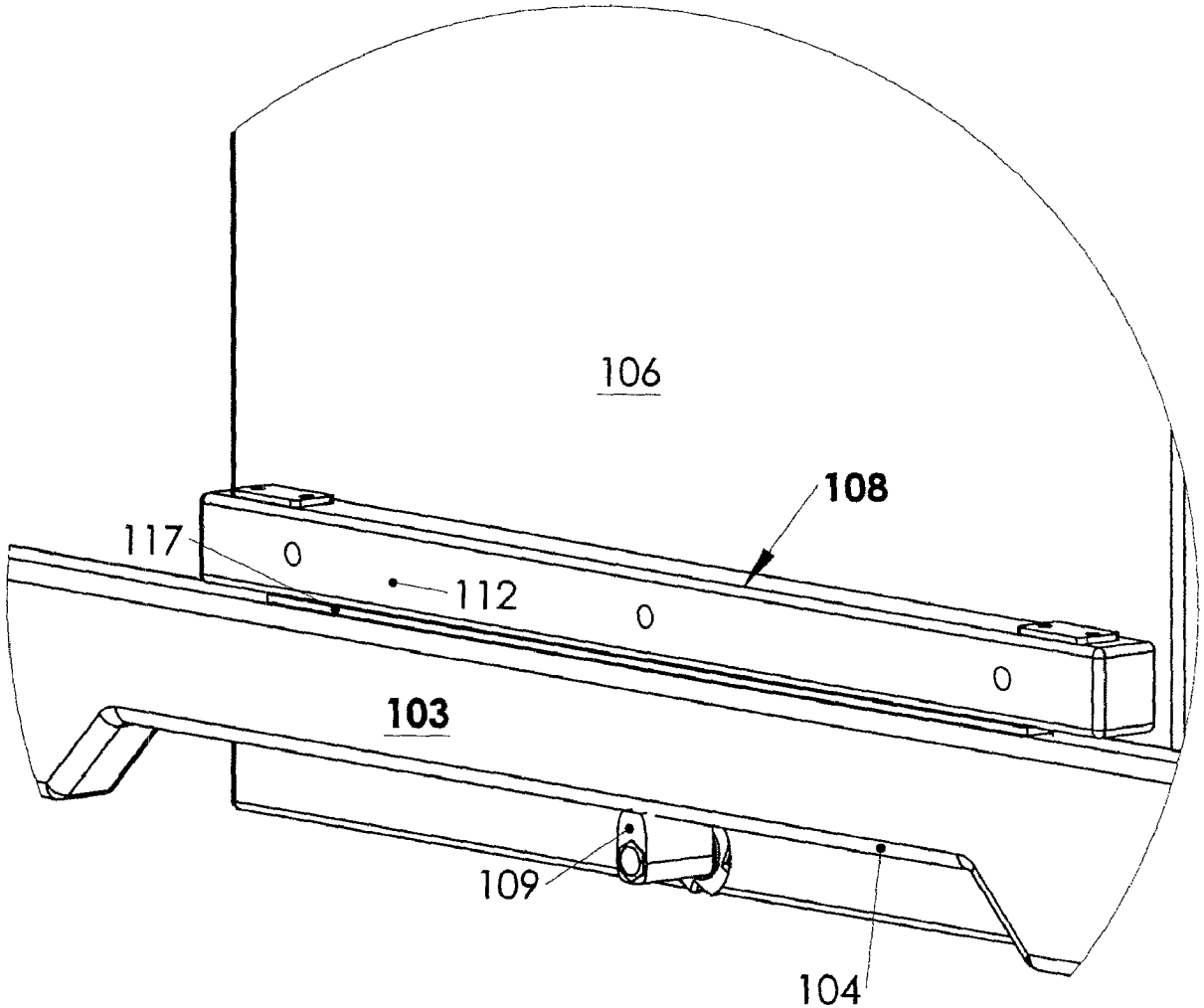
FIG. 7 is a side view of the adjustment mechanism with the cam assembly in the locked position.

When the desired location is reached, the handle 119 is turned, moving the cam 109 to the position shown in FIG. 7. The cam 109 rotates within a vertical plane relative to the side rails, which is different than the prior art locking mechanisms. This is the locked position. In the locked position the friction pad 117 is compressed between the locking rail 108 and the side rail 103, causing a substantial increase in the coefficient of friction between the two. As can be seen in FIGS. 6 and 7, the cam 109 is rotated less than 90 degrees to move it from the locked to unlocked position in the depicted embodiment. Depending on the exact shape of the cam 109 and the configuration of the locking rail, the degree of rotation could be even less or could be as much as 180 degrees. This is significantly less than the more than 360 degrees of rotations (and often multiple compete rotations) needed in prior art clamping systems.

The handle 119 is shown as a lever in the depicted embodiment, which adds to the ease of operation. However a simple knob could be used as well, this would merely require greater force to turn. In this position the plungers 114 have been pressed up into the body 112 and the friction pad 117 is engaged under compression. The combination of the clamping pressure of the cam 109 and the increased coefficient of friction between the locking rail 108 and the floor rail 103 caused by the compressed friction pad 117 causes the barrel 101 to be held in a desired position at a chosen distance X from the ladder 102. Once in a chosen position the user would perform whatever exercises are desired. If desired, the user could then change to position of barrel again to a new position to perform more exercises. The adjustment mechanism needs to be able to hold the barrel in position for the wide variety of exercises that can be performed on a ladder barrel and for a wide range user weights. Due to the leverage of the handle 119 and the increased coefficient of friction provided by the friction pad 117, the force needed on the end of handle 119 to move cam 109 into the locked position is significantly less than the force needed to hold the barrel in place. Also, the user could operate the depicted embodiment of the handle 119 with a foot, as opposed to having to bend down to tighten screws or other prior art mechanisms. This allows adjustment of the ladder barrel 100 by users with a limited range of movement or limited hand strength.

Figure 8:
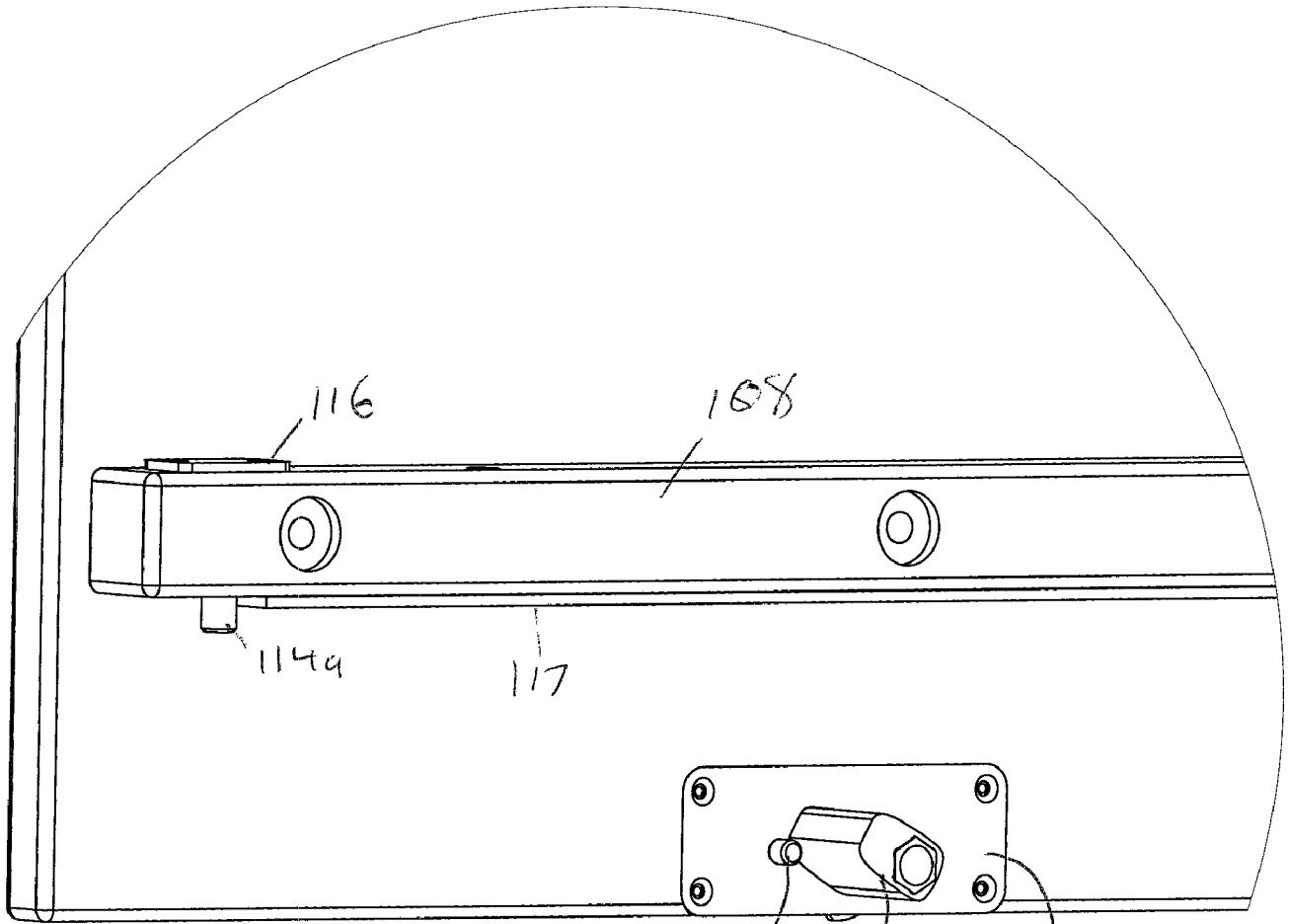
FIG. 8 is a perspective view of an alternate embodiment of the cam assembly with stops for the cam.

An alternate embodiment of the cam mounting is shown in FIG. 8. Stops 121 can be provided on each side of cam 109, which controls the amount of rotation of handle 119. This prevents the handle 119 from hitting the floor, which can damage the floor that the ladder barrel 100 is resting on. The stops 121 can be mounted directly on the side 106, 107, or on a plate 122 as shown in FIG. 8. The exact location of the stops 121 that will prevent the handle 119 from hitting the floor will depend on the shape and size of the handle 119.

While a number of exemplary aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations are within their true sprit and scope. Each apparatus embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Whenever a range is given in the specification, all intermediate ranges and subranges, as well as all individual values included in the ranges given are intended to be included in the disclosure.

In general the terms and phrases used herein have their art-recognized meaning, which can be found by reference to standard texts, journal references and contexts known to those skilled in the art. The above definitions are provided to clarify their specific use in the context of the invention.

I claim:

1. A ladder barrel comprising:

a base frame having side rails and two end pieces;

a ladder mounted at one end of the base frame;

a barrel slidably mounted on the side rails such that a distance X between the barrel and the ladder can be changed;

at least one cam mechanism and locking rail functioning together to fix the barrel on the side rails at a chosen distance X ;

the cam mechanism having a unlocked position and a locked position;

the cam mechanism being operated by a handle, and the locked and unlocked position being within 180 degrees of each other; and a friction pad between the locking rail and base frame to increase the friction between the locking rail and the base frame.

2. The ladder barrel of claim 1 wherein the at least one cam mechanism and the locking rail are mounted on the barrel.

3. The ladder barrel of claim 1 wherein the locking rail further comprises at least one biasing mechanism functioning hold the locking rail away from the base frame to disengage the friction pad when the cam mechanism in the unlocked position.

4. The ladder barrel of claim 1 wherein the cam mechanism is moved from the unlocked to the locked position using a lever.

5. The ladder barrel of claim 3, wherein the biasing mechanism is at least one plunger biased to an extended position by at least one spring.

6. The ladder barrel of claim 5, wherein the biasing mechanism is mounted on the locking rail and presses the plunger against the base frame.

7. The ladder barrel of claim 1, wherein the locked and unlocked position of the cam are within 90 degrees of each other.

8. The ladder barrel of claim 1, wherein the cam is located beneath the side rail and the locking rail is located above the side rail.

9. The ladder barrel of claim 1, wherein the friction pad is compressed between the locking rail and the side rail when the cam is in the locked position.

10. The ladder barrel of claim 4 further comprising a stop to prevent the lever from moving beyond a desired amount of rotation.

* * * * *